US007051995B2

(12) United States Patent
Tornqvist

(10) Patent No.: US 7,051,995 B2
(45) Date of Patent: May 30, 2006

(54) DEVICE FOR GENERATING A RECIPROCATING MOVEMENT, VALVE ARRANGEMENT THEREFORE AND PHEUMATIC TOOL

(76) Inventor: Peter Tornqvist, Oskarsvagen 16, Lidingo (SE) S-181 32

( * ) Notice: Subject to any disclaimer, the term of this patent is extended or adjusted under 35 U.S.C. 154(b) by 16 days.

(21) Appl. No.: 10/506,724

(22) PCT Filed: Mar. 1, 2003

(86) PCT No.: PCT/EP03/02118

§ 371 (c)(1),
(2), (4) Date: Sep. 7, 2004

(87) PCT Pub. No.: WO03/074234

PCT Pub. Date: Sep. 12, 2003

(65) Prior Publication Data

US 2005/0109521 A1 May 26, 2005

(30) Foreign Application Priority Data

Mar. 5, 2002 (EP) ..... 02445029

(51) Int. Cl.
*B25D 9/20* (2006.01)
*B25D 9/12* (2006.01)

(52) U.S. Cl. ..... 251/211; 251/318; 173/17; 173/206

(58) Field of Classification Search ..... 251/211, 251/318; 173/17, 206
See application file for complete search history.

(56) References Cited

U.S. PATENT DOCUMENTS

| | | | | |
|---|---|---|---|---|
| 526,342 | A | 9/1894 | Carlinet | |
| 1,861,042 | A * | 5/1932 | Zublin | 173/73 |
| 2,705,501 | A * | 4/1955 | Fritzsch | 137/112 |
| 2,913,005 | A * | 11/1959 | Grant et al. | 137/625.6 |
| 4,450,920 | A | 5/1984 | Krasnoff et al. | |
| 4,592,431 | A | 6/1986 | Tornqvist | |
| 4,660,658 | A | 4/1987 | Gustafsson | |
| 4,667,748 | A | 5/1987 | Lavon | |
| 5,065,824 | A | 11/1991 | Ottestad | |
| 5,082,067 | A | 1/1992 | Tornqvist | |
| 5,108,400 | A * | 4/1992 | Appel et al. | 606/79 |
| 5,137,436 | A * | 8/1992 | Vogel | 417/404 |
| 5,899,232 | A * | 5/1999 | Cardoso et al. | 137/625.5 |
| 6,341,761 | B1 * | 1/2002 | Brunner et al. | 251/318 |

* cited by examiner

*Primary Examiner*—J. Casimer Jacyna
(74) *Attorney, Agent, or Firm*—David Guerra

(57) ABSTRACT

A pressure-fluid driven device for generating a reciprocating movement includes a first (5) and a second relatively movable part (3), wherein a working chamber (7) is intended to be alternatively pressurised and depressurised so as to drive the parts in a movement relative to each other when the working chamber is pressurised. A valve arrangement (8) is intended to control the fluid flow into as well as from the working chamber. The inlet into the working chamber (7) is separate from the discharge from the working chamber (7). The invention also concerns a valve arrangement and a pneumatic tool.

10 Claims, 2 Drawing Sheets

DEVICE FOR GENERATING A RECIPROCATING MOVEMENT, VALVE ARRANGEMENT THEREFORE AND PHEUMATIC TOOL

FIELD OF THE INVENTION

The invention concerns a pressure-fluid driven device for generating a reciprocating movement according to the preamble of claim 1. It also concerns a pneumatic tool including such a device.

DESCRIPTION OF PRIOR ART

Such a device is known from U.S. Pat. No. 5,082,067. One embodiment in that document includes a working chamber between two relatively movable parts, each with a channel or conduit for supply or discharge of pressure-fluid drive medium, appropriately compressed air. An axial movement of a tubular upright displaces the valve element from its seat, thereby opening a fluid path to supply drive medium into the working chamber.

Pressurising the working chamber displaces the movable parts in mutually opposite directions, and when the movable parts have been sufficiently separated, the supply channel closes and the discharge channel in the upright opens for discharge of the drive medium allowing the relatively movable parts to approach each other so as to repeat the procedure described above. A reciprocating movement is obtained by using a system of springs or other means to return the parts towards each other after depressurisation.

Using the described embodiment would be very useful in an arrangement where the two movable parts are mutually discrete and disposed one after the other in the same housing. This arrangement would be very attractive as the tool diameter can be made smaller and it therefore should provide for tools, which are easier to handle, have less demands on tolerances, have lower manufacturing cost, have less number of bearing surfaces and thus lower vibration level. However, a device built in the described manner has an effective output, which is too low to be of any practical use.

AIM AND MOST IMPORTANT FEATURE OF THE INVENTION

It is an aim of this invention to provide a solution to the problems of the prior art and to suggest a solution making it possible to achieve better effective output while maintaining the advantages of the prior art.

It is a further aim to provide a solution allowing dimensional advantages and simple and economic manufacture because of the possibility of obtaining a device having reduced dimensions with maintained performance, compared to prior art. It is still a further aim to make these improvements useful for devices working as pneumatic tools including systems for vibration reduction.

These aims are achieved according to the invention through the features of claim 1.

By providing control means connected to at least one of the valve elements so that the valve elements of the valve arrangement are axially separated, thus positioning the fluid inlet to the working chamber separated from the fluid discharge, several advantages are achieved. The positions and dimensions of the inlet and discharge are independent of each other. Thus, each one can be independently optimized to suit the function and flow characteristics desirable for the specific application for which the device is to be applied.

According to a particularly preferred aspect, the valve elements are connected to each other by the control means, (e.g. a stem) so as to form a valve body. This provides for excellent self-adjustment properties.

By allowing the valve elements to perform a limited movement relative to each other during operation, the operating cycle may be further optimised. This possibility provides for advantageous control of the operating cycle and thus enhanced performance. For example, the period when pressure-fluid is active inside the working chamber prior to discharge can be prolonged.

This function may be obtained by the connection between the valve elements being elastically flexible. The operating cycle can also be advantageously altered by at least one of the valve elements being flexible. A corresponding functional advantage is achieved by instead having at least one of the valve seats being elastically flexible.

The fluid pressure may also act on one or both of the valve elements to ensure that the element or elements is or are in the intended position or positions to perform the desired function.

Placing the two movable parts in a common housing in such a way that they are mutually discrete and disposed one after the other and each part is sealing against the housing, makes it possible not only to build devices with smaller diameters, but also with smaller sealing surfaces and a lesser number of bearing surfaces. This tends to lower manufacturing costs and influence several other important variables positively and produce more power and lower noise and vibration level.

Further advantages are achieved through the features of the other dependent claims.

BRIEF DESCRIPTION OF THE DRAWINGS

The invention will now be described in more detail with reference to the annexed drawings, wherein.

DESCRIPTION OF PREFERRED EMBODIMENTS

In this description like elements in different embodiments may carry the same reference signs.

Figure 1:
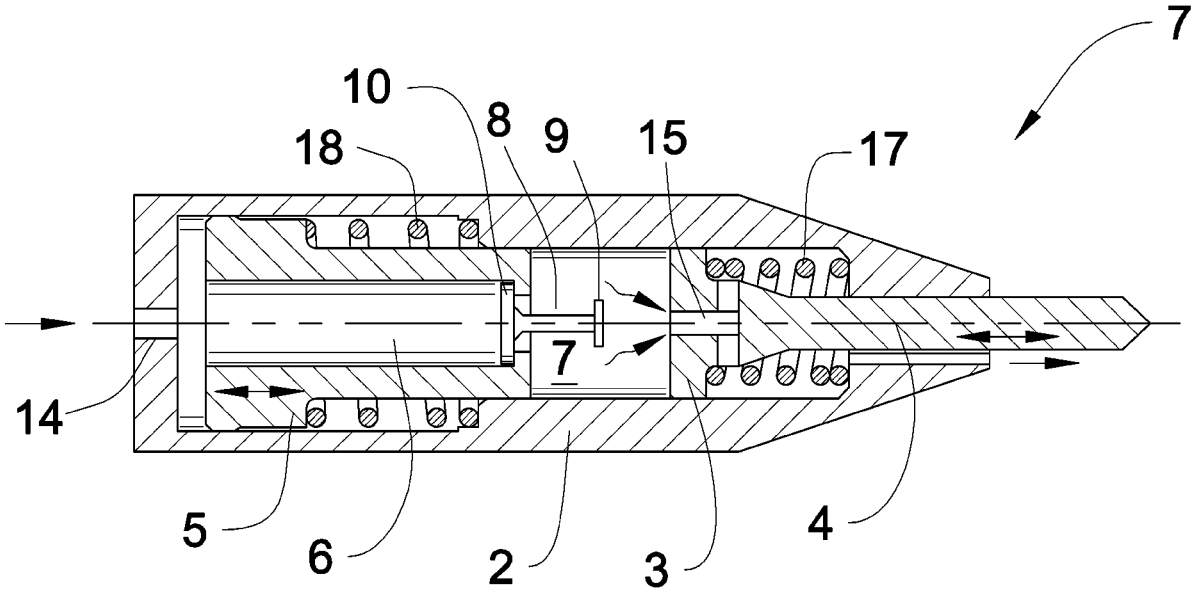
FIG. 1 shows, in an axial section, a device according to the invention in a first position.

In FIG. 1 reference sign 1 refers to a pressure-fluid driven device for generating a reciprocating movement. The device includes a housing 2, which encloses a first movable part 5 having a first channel or a fluid passage 6. Also a second movable part 3 is enclosed inside the housing 2. The part 3 is designed with an integral part 4 (in this case a stylus, but other designs with files, knives, saws, chisels etc. may also be used or it can be a piston hitting on a chisel, anvil, needles or similar) for performing some operation on a work piece (not shown). The movable parts delimit a working chamber 7 together with the housing 2.

The device may be adapted for generating a reciprocating movement, which can be used also for other applications involving driving members intended for reciprocation.

Pressure-fluid from a pressure-fluid source (not shown) is let into the housing 2 over an inlet 14 and passes through the fluid passage 6 into the working chamber 7 and is discharged from this working chamber 7 over a second channel or a discharge passage 15 to an outlet. The outlet is in the case of the shown embodiment arranged as channels through the wall of the housing 2.

The pressure-fluid flow through the device 1 is controlled by a valve arrangement, which includes a valve body 8 having a first valve element 10, which co-operates with the first movable part 5 and a second valve element 9, which co-operates with the second movable part 3.

Figure 2:
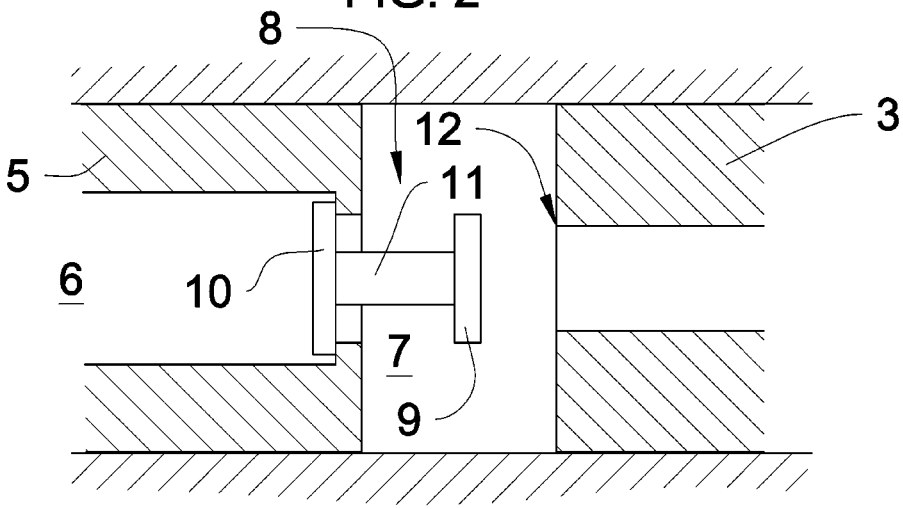
FIGS. 2 and 3 show, in axial sections and in enlarged scale, the valve arrangement in different positions.
Figure 3:
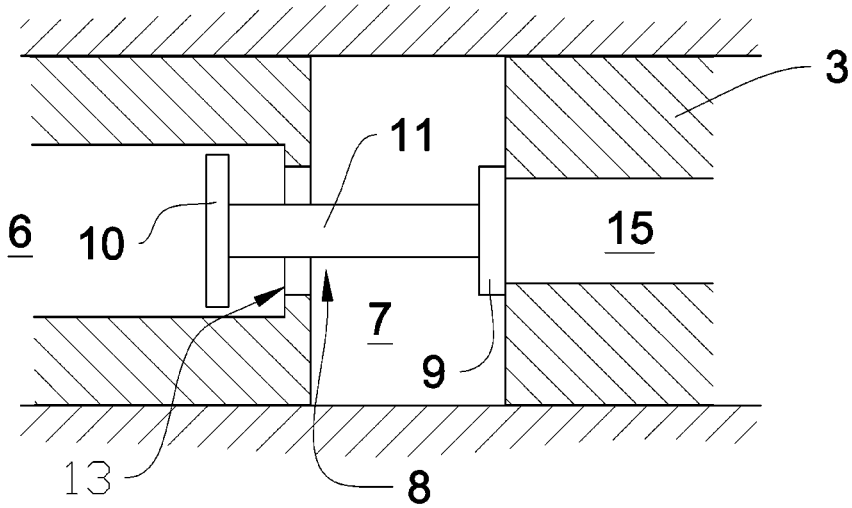

This is shown in greater detail in FIGS. 2 and 3. FIG. 2 shows the position of the valve body 8 when the two movable parts are far away from each other and the discharge passage 15 is open. FIG. 2 shows in particular the first valve element 10 co-operating with a surface which is positioned on an upstream side of the first part 5, and comprising a first valve seat 13. The second valve element 9 co-operates with a second valve seat 12, which is provided on the second part 3 (FIG. 3).

This means that pressure in fluid coming from the pressure-fluid inlet 14 in FIG. 1 urges the first valve element 10 against the first valve seat 13 in the position as seen in FIG. 2. Similarly, the second valve element 9 is pressed, through fluid pressure, which is being present inside the working chamber 7, in a direction against the second valve seat 12, so as to close the passage from the working chamber into the discharge passage 15 as shown in FIG. 3.

FIGS. 2 and 3 also show that the valve body 8 includes a control means, in this case a stem 11 for connecting the first and second valve elements 9 and 10, respectively. The valve elements are thus axially separated a chosen distance from each other. The stem 11 is accordingly dimensioned so as to allow a chosen distance between the parts 3 and 5 in order to provide for separation of the inlet and outlet areas. According to the invention this feature provides advantageous flow characteristics with respect to flow of fluid into as well as out from the working chamber without the respective flow being disturbed or restricted by elements belonging to the other one of the respective one of the inlet or outlet functions. The stem is rigid in the embodiment shown but may also be flexible, which will be discussed later. The construction with the valve elements and the control means being an integral unit, which is free, in such a way that both valve elements are movable with respect to the parts, is advantageous in that it allows self-adjustment and makes the device relatively insensitive to tolerances.

Further, in FIG. 1 it is shown that the first part 5 is associated with a first force accumulator, in this case a spring 18. This spring 18 is put under increased load as the first movable part is moving in a first direction, i.e. forward or to the right in FIG. 1.

As the pressure-fluid drive medium enters the working chamber 7 through the inlet channel 6 passed the valve element 10, the two parts 5, 3 are driven in opposite directions, the first part 5 to the left in FIG. 1, under simultaneous decrease of the load on its associated spring, and the second part 3 to the right under simultaneous increase of the load on its associated force accumulator, in this case a spring 17. The total of the reaction forces which are applied by the two springs directly or indirectly to the housing 2 will therefore remain substantially constant through the entire movement cycle, which lowers vibrations of the housing. Naturally other force accumulators than springs may be used, e.g. draft springs, bellows, gas springs, rubber hoses etc.

Figure 4:
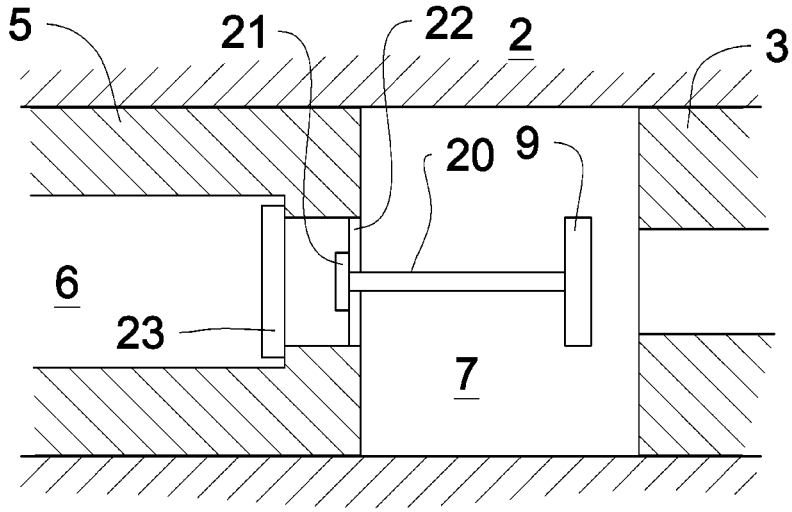
FIG. 4 shows, in an axial section, a second embodiment of the invention.

In the embodiment of FIG. 4, the valve elements are separated elements and the second valve element 9 is provided with a control means 20 in the form of a stem which is guided in the first part so as to allow a restricted movement relative thereto. For that purpose, opposite to the second valve element it is provided with an enlargement 21 which co-operates with holding elements in the first part 5 so as to prevent the control means from falling out from the first part 5. The control means 20 is arranged to urge a first valve element 23 into an open position when the working chamber 7 contracts, i.e. the parts approach each other, and to urge the second valve element 9 into an open position when the working chamber 7 expands, i.e. the parts move away from each other.

It should be noted that the construction described with respect of FIG. 4 may be inverted in the sense that the first valve element could be attached to the control means which in that case would be guided in the second part. The valve elements would then be affected similar to the above case.

Figure 5:
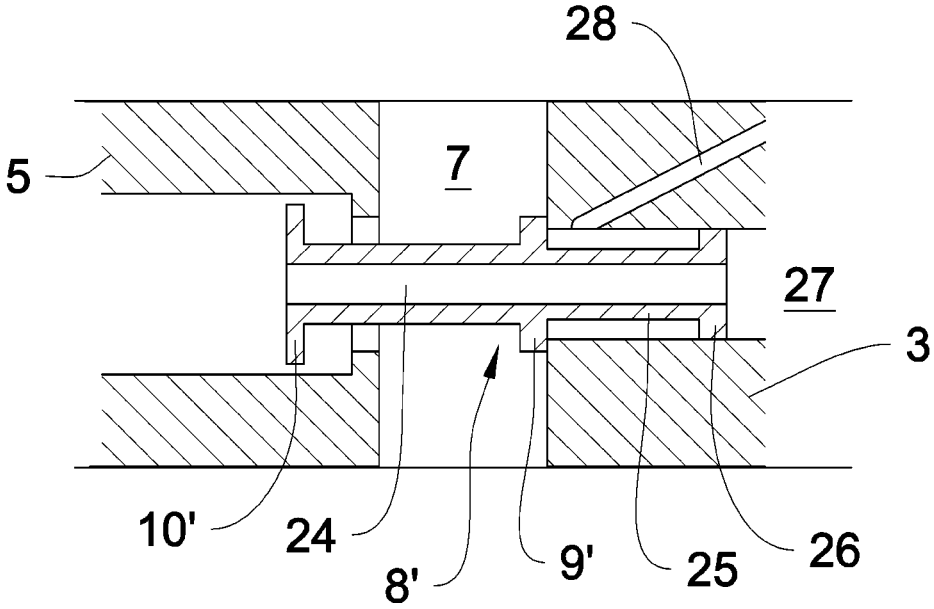
FIG. 5 shows, in an axial section, a third embodiment of the invention.

In the embodiment of FIG. 5, an arrangement is shown which in principle operates in the same manner as the arrangements shown in FIGS. 1–3. However, a valve body 8' having valve elements 9' and 10' is provided with a conduit 24 which functions so as to provide pressure fluid communication between volumes (not shown) on either side of the parts 3 and 5. This is advantageous e.g. if high pressure fluid is used for clean blowing purposes, for keeping a tool (e.g. a chisel) in a specific position, to reduce the force needed to open the valve for incoming fluid etc. In the shown embodiment, the valve body 8' has an extension 25 with an enlargement 26 at its free end matching inside the channel 27, and serving for guiding and sealing purposes. Outgoing fluid is discharged through a discharge channel 28, which opens downstream the valve seat for the valve element 9'. The extension 24 and the enlargement 26 are however optional with respect to the principle of pressure fluid communication through the conduit 8'.

The invention may be modified within the scope of the annexed claims. The invention may also be applicable in virtually any equipment using reciprocating movement besides tools.

The operating cycle can be modified by generally arranging for allowing the valve elements to perform a relative movement between each other, e.g. by making the stem 11 flexible. The operating cycle can also be modified by using valve elements, which provide flexible co-operation with the movable parts. A further way of modifying the operating cycle is to use valve reception means, such as seats, being flexible for offering flexible co-operation with the valve elements.

The valve arrangement can be made in many different ways including being comprised of sliding valve elements being positioned in the respective parts.

Either one of the movable parts may be used as an active working part, but both parts can also be used for performing the useful work. They can e.g. impact on different parts of an anvil.

The embodiment of FIG. 1 may be amended such that one of the parts is fixedly attached to a support structure. Thus, in this case only the other one of the parts is free to move. The housing may be separate from, integral with or fixed to any of the respective parts.

Instead of using compression springs to return the movable parts towards each other there are many other possibilities including using pressure-fluid from the pressure-fluid source.

The invention claimed is:

1. A pressure-fluid driven device for generating a reciprocating movement, comprising:

a first and a second axially relatively movable part, wherein a working chamber is intended to be alternatively pressurized so as to drive said parts in a movement relative to each other and depressurized, said first part is provided with a first channel for supply of driving fluid to said working chamber and said second part is provided with a second channel for discharge of fluid from said working chamber; and a valve arrangement having at least two valve elements which are being movable relative to said first and second parts is arranged to control the fluid flow in said first and second channel in dependence of the relative positions of said first and second parts, and thereby the pressurization of said working chamber, characterized in that said valve arrangement includes control means connected to at least one of said two valve elements so that said valve elements are axially separated from each other such that a fluid inlet into said working chamber of said first channel is separated from a fluid discharge from said working chamber into said second channel.

2. The pressure-fluid driven device according to claim 1, characterized in that the valve elements are comprised of a first valve element for controlling the fluid flow in the first channel and a second valve element for controlling the fluid flow in the second channel.

3. The pressure-fluid driven device according to claim 2, characterized in that at least one of the valve elements in operation is arranged to be brought into sealing co-operation with its corresponding channel by the fluid pressure in a position intended for sealing co-operation.

4. The pressure-fluid driven device according to claim 3, characterized in that the valve elements are connected to each other by said control means so as to form a valve body.

5. The pressure-fluid driven device according to claim 3, characterized in that the valve elements are arranged so as to allow a relative movement between each other.

6. The pressure-fluid driven device according to claim 5, characterized in that at least one of the elements selected from the group of said control means, said valve elements and valve element reception means, is elastically flexible.

7. The pressure-fluid driven device according to claim 1, characterized in that the first and the second parts are arranged in a housing including an inlet and an outlet for pressure-fluid and that the first as well as the second part is movable with respect to the housing.

8. The pressure-fluid driven device according to claim 7, characterized in that the two movable parts are arranged sealingly against the housing in order to form the working chamber.

9. The pressure-fluid driven device according to claim 8, characterized in that a first force accumulator is coupled to one of the parts and is arranged to be put under increased resilient force producing load as a response to movement of that part in a first direction which is against the working chamber for that part and that a second force accumulator is coupled to the other part and is arranged to be put under increased resilient force producing load as a response to movement of that other part in said first direction.

10. The pressure-fluid driven device according to claim 1, further comprising a pneumatic tool.

* * * * *